US007497260B2

(12) United States Patent
Telfer

(10) Patent No.: US 7,497,260 B2
(45) Date of Patent: Mar. 3, 2009

(54) JUNK REMOVAL TOOL

(75) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 411 days.

(21) Appl. No.: 10/510,016

(22) PCT Filed: Apr. 1, 2003

(86) PCT No.: PCT/GB03/01426

§ 371 (c)(1),
(2), (4) Date: Feb. 23, 2005

(87) PCT Pub. No.: WO03/083253

PCT Pub. Date: Oct. 9, 2003

(65) Prior Publication Data

US 2007/0131426 A1 Jun. 14, 2007

(30) Foreign Application Priority Data

Apr. 2, 2002 (GB) ..... 0207563.8

(51) Int. Cl.
*E21B 31/08* (2006.01)
*E21B 37/00* (2006.01)

(52) U.S. Cl. ..... 166/301; 166/299

(58) Field of Classification Search ..... 166/99, 166/301

See application file for complete search history.

(56) References Cited

U.S. PATENT DOCUMENTS

| | | | | |
|---|---|---|---|---|
| 4,084,636 | A * | 4/1978 | Burge | 166/66.5 |
| 4,276,931 | A * | 7/1981 | Murray | 166/99 |
| 4,515,212 | A | 5/1985 | Krugh | |
| 5,682,950 | A * | 11/1997 | Bjornstad | 166/99 |
| 6,176,311 | B1 | 1/2001 | Ryan | |
| 6,276,452 | B1 * | 8/2001 | Davis et al. | 166/298 |

FOREIGN PATENT DOCUMENTS

| | | |
|---|---|---|
| GB | 2295838 | 11/1995 |
| WO | WO 92/19838 | 11/1992 |
| WO | WO 00/58602 | 10/2000 |

* cited by examiner

*Primary Examiner*—William P Neuder
(74) *Attorney, Agent, or Firm*—Osha • Liang LLP

(57) ABSTRACT

A junk removal tool (10) for use in a well bore. The tool includes a multi-faceted face (42) of tungsten carbide to break up large pieces of junk. The junk is then captured in the tool via large area inlet ports (40) and collected in a trap (31). In one embodiment, valves (41) are placed at the inlet ports to prevent the out-flow of captured junk. A further embodiment includes a throat portion (52) to jet junk laden fluid into the tool.

14 Claims, 3 Drawing Sheets

JUNK REMOVAL TOOL

This patent application claims priority from Application No. PCT/GB03/01426, filed 1 Apr. 2003, which claims priority from GB0207563.8 filed 2 Apr. 2002. The present invention relates to downhole tools for use in removing junk from a well bore.

When drilling or completing a well bore, it is accepted that a large amount of junk can be present within the well bore. Such junk may comprise debris which are generally considered to be small particles of such things as metal shavings, chips, twists or curls, together with particles of cement or scale which may have previously adhered to the walls of the casing or liner. In this group is included mud and other particulates found in fluids circulated within the well bore. A further category of junk is larger objects. These may include portions of tools which have been discarded or been broken within the well bore, or large sections of the tubulars which have been cut away when portions of the casing or liner have been milled or drilled, for example, following casing milling or window cutting. Additionally such junk can be produced after perforation.

A number of downhole tools have been developed for collecting and retrieving junk found in a well bore. This Application is primarily directed towards the collection of large pieces of junk which cannot be circulated out of the well bore.

Apparatus within a well bore designed to collect junk primarily fall into two categories dependent upon the location of the tool on a work string. The first category relates to apparatus mounted at the bottom of the work string. This apparatus collects all fluids and materials within the well bore as fluids are circulated up the well bore or as the tool is run into the well bore. Such tools are typically referred to as junk catchers and an example is that disclosed in U.S. Pat. No. 4,515,212 to Marathon. This tool has a collection of petals arranged at the distal end of the work string. As the tool is run into the well, the petals are forced outward to the walls of the well bore where they act to siphon all material through a single large port on the longitudinal axis of the tool. When the tool is pulled from the well the petals close thereby catching large debris and pulling it from the well.

A significant disadvantage of this tool is that it must be positioned at the end of a work string and thus is typically used on a single run. To operate a dedicated run merely for the purposes of clearing junk is both time-consuming and expensive.

The second category of junk catchers can be mounted at any position on a work string to allow the tool to be run at the same time as other tools. A tool of this type is disclosed in U.S. Pat. No. 6,176,311 to Baker Hughes Incorporated. The tool has a wiper or scraper blade arranged to prevent the fluid including the junk to pass up the annulus between the tool and the well bore wall. The fluid including the junk is forced into a port and through a passage in the tool around the wiper. A filter and a trap are positioned within the passage to catch the junk, which is too large to pass through the filter.

Such tools have a disadvantage in that they can only handle smaller pieces of junk, generally referred to as debris. The is because the input port is sized to ensure that a significant flow velocity is maintained to circulate the fluid through the tool. As a result of this narrow flow path, these tools generally include a by-pass means which rupture to allow the fluid to escape when the filter has been clogged with large debris. Thus, when large debris is present the tool cannot function correctly and, in fact, generally shuts down into a mode that allows the fluid including the junk to by-pass the tool. Additionally, junk tends to 'ball-up' at the scrapers or wipers as the larger pieces of junk are swept away from the inlet port up the annulus to become jammed or located around the wiper blades.

It is an object of at least one embodiment of the present invention to provide a downhole tool which can be positioned anywhere on a work string and which can collect large pieces of junk from within the well bore.

It is a further object of at least one embodiment of the present invention to provide a downhole tool for collecting or retrieving junk from a well bore which can break up large pieces of junk so that they can be collected and retrieved from the well bore.

According to a first aspect of the present invention, there is provided a downhole tool for collecting and retrieving junk from a well bore, the tool comprising a cylindrical body attachable in a work string, a multi-faceted surface arranged at an end of the body for contacting with and breaking up junk and a plurality of inlet ports through which the broken up junk passes into a trap for collection.

Thus the tool is suitable for retrieving large pieces of junk by breaking up the junk before collection. In addition the plurality of input ports provide a large access area to gather the broken junk into the trap.

Preferably the multi-faceted surface comprises a plurality of projections, each projection being located between adjacent inlet ports. More preferably the projections include a plurality of tungsten carbide coated surfaces to provide a grinding and/or milling action to assist in breaking up the junk.

Preferably the tool includes a sleeve located around the body, the sleeve including filter means for filtering debris from fluid passing there through. Preferably also the trap is provided in an annular space between the body and the sleeve.

Preferably, the sleeve is detachable. This is arranged so that when the tool is pulled from the hole the sleeve can be removed and the junk can be disposed of.

Preferably, the inlet ports are arranged equidistantly around the cylindrical body. Advantageously the ports are perpendicular to a longitudinal axis of the tool so that they are in the flow path. There may be four inlet ports.

Advantageously, each inlet port includes a valve to prevent debris from falling back through the port once it has entered. Preferably, the valves are flap valves. These flap valves may be operated by a spring so that they can be opened by fluid pressure but are urged to a closed position.

Preferably, also, the tool includes a throat. The throat may be a cylindrical body located adjacent to the projections such that the diameter of the throat is narrower than the diameter of the sleeve to allow a clear access to the inlet ports.

Preferably the cylindrical body includes an axial bore to permit fluid flow through the work string.

Preferably, also, the tool may include one or more milling elements designed to be run in ahead of the projections. Such an arrangement of additional milling heads will tend to jet the junk towards the projections and inlet ports of the tool.

According to a second aspect of the present invention, there is provided a method of collecting and retrieving junk within a well bore, comprising the steps:

(a) providing a multi-faceted contact surface on a work string, the surface including a plurality of inlet ports;

(b) breaking up large pieces of junk by contact with the surface;

(c) collecting the broken-up junk through the inlet ports; and (d) storing the broken-up junk in a trap adjacent the inlet ports.

Preferably, also, the method may further include the step of providing a mill ahead of the surface and jet milled junk from the mill towards the inlet ports.

Preferably, also, the method includes the step of operating one or more valves at each inlet to prevent the broken-up junk from exiting the trap.

An embodiment of the present invention will now be described, by way of example only, with reference to the accompanying figures of which:

Figure 1:
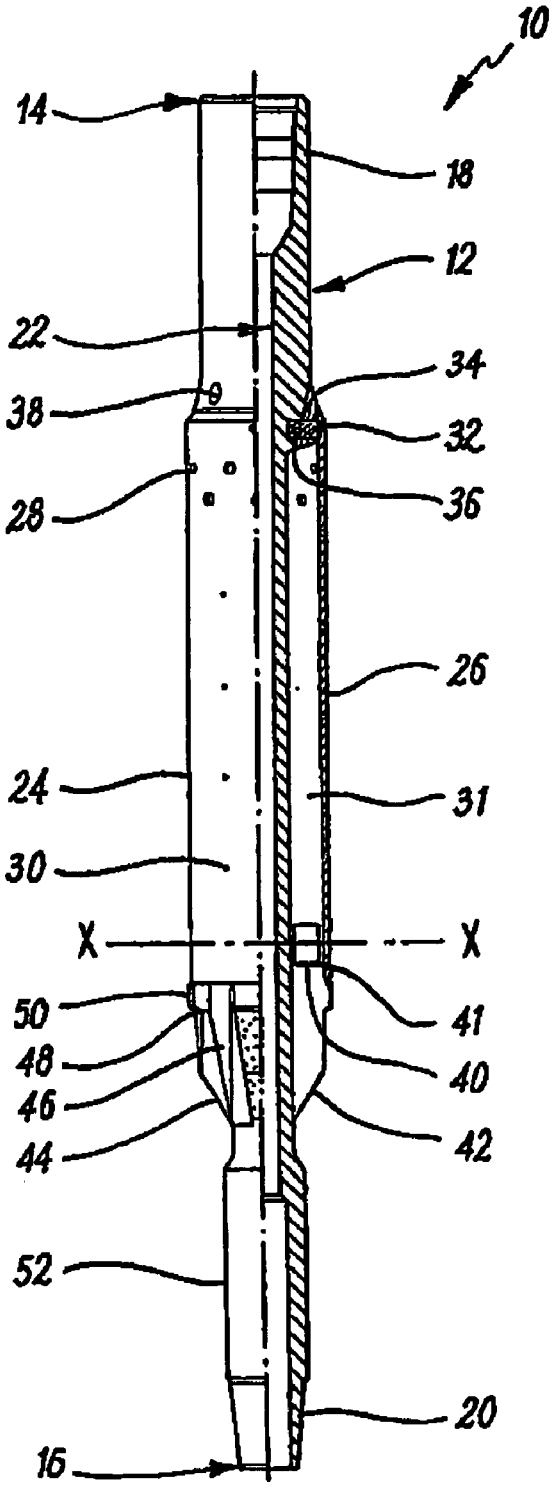
FIG. 1 is a part cross-sectional view of a downhole tool according to an embodiment of the present invention.

Reference is initially made to FIG. 1 of the drawings, which illustrates a downhole tool, generally indicated by Reference Numeral 10, according to an embodiment of the present invention. Tool 10 comprises a cylindrical body 12, having an upper end 14 and a lower end 16. It will be appreciated that the reference to upper and lower can be considered to relate to the position with respect to the entry port of the well bore and thus the tool can be used in a vertical, inclined or horizontal position as required. At the upper end 14 of the tool 10 there is located a box section 18 for connection of the tool to a work string (not shown). At the lower end 16 there is a pin section 20 for connection of the tool 10 to the lower portion of the drill string (not shown). As will be appreciated, the tool 10 can be inserted within a work string. Body 12 includes an axial bore 22 providing an access for fluid from the upper end 14 to the lower end 16 of the tool through a longitudinal passage.

Located around the body 12 is a sleeve 24. Sleeve 24 provides a thin annular wall 26, which includes ports 28, 30. Ports 28, 30 allow for the passage of fluid and small debris to exit the tool 10 via the sleeve 26. As can be seen from the Figure, ports 28 are larger than ports 30 and are arranged towards the upper end 14 of the tool.

Sleeve 24 is held in place via connecting screws 32 which locate through a port 34 on the body 12. Screws 32 are inserted into the port 34 and contact a conical spring 36 which assists in holding the screw 32 in place. When mounted there is provided a trap 31 formed by an annular space created between the body 12 and the sleeve wall 26.

Further ports 38 are arranged on the body 12 to provide a substantially longitudinal exit path to expel fluid and small debris from sleeve 24 out with the body 12.

Figure 2:
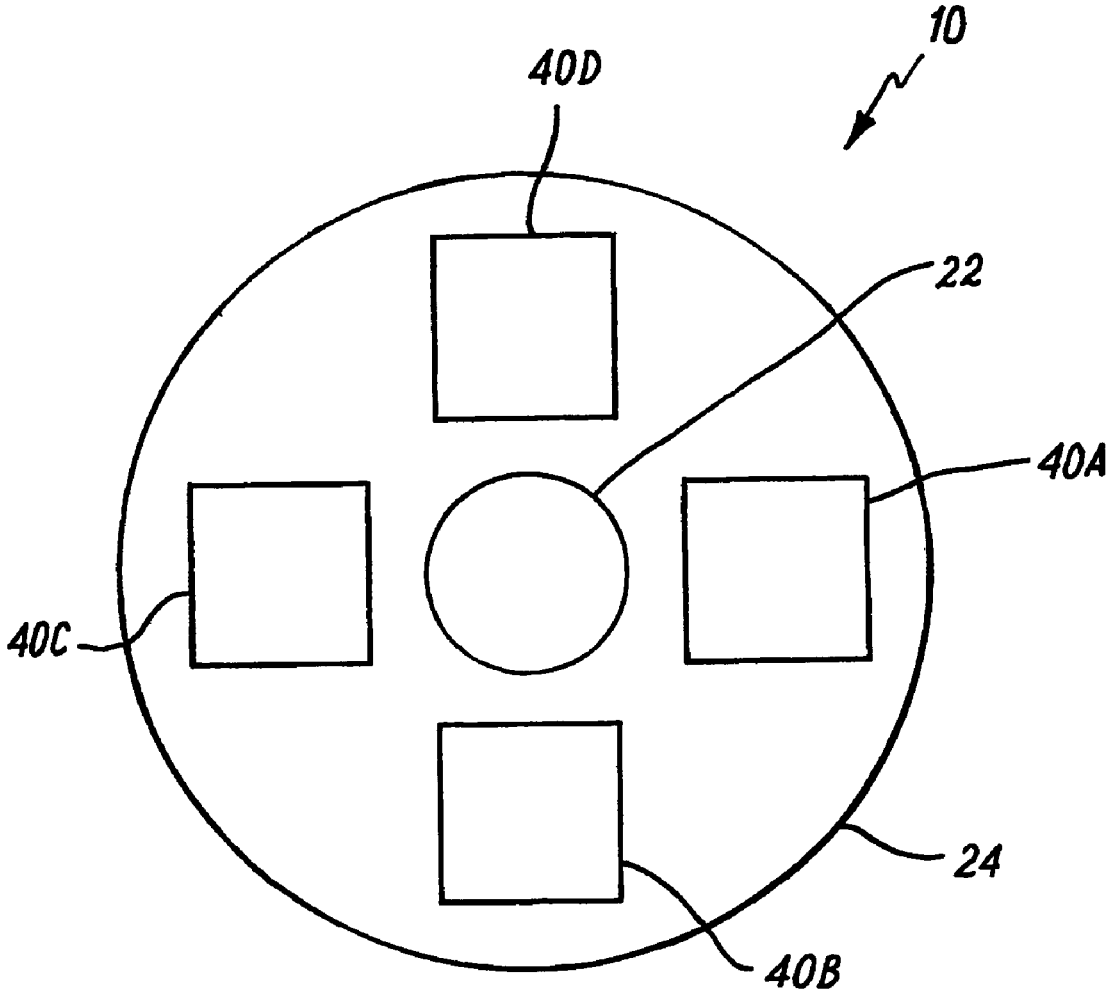
FIG. 2 is a cross-sectional view of the downhole tool of FIG. 1 through section line X-X.

At the lower end of the sleeve 24 there are arranged inlet ports 40. Each inlet port includes a flapper valve 41. Reference is now made to FIG. 2 of the drawings, which illustrates a cross-sectional view through the tool of FIG. 1 at the location of the inlet ports 40. Four inlet ports 40A-D are arranged on the tool being equidistantly spaced around the central bore 22. Each inlet port 40A-D has a square cross-sectional area and together the inlet ports 40A-D provide a substantial flow path for junk into the tool. In the embodiment shown the sleeve 24 has a diameter 8.25 inches and each inlet port is a 2 inch×2 inch square.

Valves 41 are flow assisted so that they open under flow of material and are spring assisted to close.

Below the sleeve 24, is located a multi-faceted surface 42 on the body 12. Multi-faceted surface 42 comprises a number of projections 44. In the embodiment shown there are four projections, each located between adjacent inlet ports 40. Thus, a channel 46 exists between neighbouring projections to direct fluid and junk into the inlet ports 40.

Each projection 44 has a plurality of surfaces. One surface is a transverse surface 48, substantially perpendicular to the longitudinal axis of the tool. The transverse surface 48 is arranged to contact the top of a polished bore receptacle when the tool 10 is run into a well bore. The surface 42 has a coating of tungsten carbide so that the projections 44 can provide a milling action when moved against a surface in the well bore e.g. a polished bore receptacle or a large piece of junk. Further, the projections include a raised surface 50 which assist in stabilising the tool within the well bore and thus the projections 44 can be considered as stabilisation blades.

Located below the projections 44 is a throat portion 52 of the tool 10. Throat portion 52 has a cylindrical body with a diameter which is smaller than the diameter of the sleeve 24. This provides a throat area for junk to be swept into the channels 46 for entry through the inlet ports 40.

In use the tool is connected to a work string via the box section 18 and the pin section 16. The tool can be run on the same trip as a pre-completion mechanical well bore clean-up run or during a dedicated junk clean-out run. The tool is run into the well bore and can be run to a location where the tangential surface 48 lands on the liner top of a polished bore receptacle and the clean-up string is at TD. The tool can then-be rotated to drill/mill/polish any assemblies via rotation and reciprocation as the multi-faceted surface 42 of the projections 44 can contact the walls of the well bore.

When run into a well bore or alternatively when fluid is circulated towards the tool, junk which is present in the fluid will be forced passed the throat 52 and into the large inlet ports 40 via the flapper valves 41. Due to the flow against the flapper valves 41 they will open and the junk laden fluid will enter the trap 31. The fluid and small debris can exit through the ports 30, 28, 38 while the larger debris will become trapped and be retained in the trap 31. Debris and junk which is larger than the size of an inlet port 40 will be broken up by the multi-faceted surface 42 on the projections 44. Thus, large pieces of junk will be cut up and shattered on the projections 42 and drawn in to the trap 31 through the inlet ports 40. The size and location of the projections 42 ensure that the junk is broken up into pieces which can fit in the channels 46 and thus through the inlet ports 40. The diameter of the throat 52 provides a maximum by-pass swallowing capacity also.

When work is complete and the tool is withdrawn from the hole or remains stationary at a point in the well bore, flapper valves 41 will automatically close via the spring connections and the junk within the trap 31 is prevented from falling out of the tool 10 as the tool is raised to the surface, or when the flow is removed from an upward direction in relation to the tool position.

As the inlet ports 40 are arranged uniformly around the central bore 22, significant amounts of junk can be collected within the tool and raised to the surface.

Figure 3:
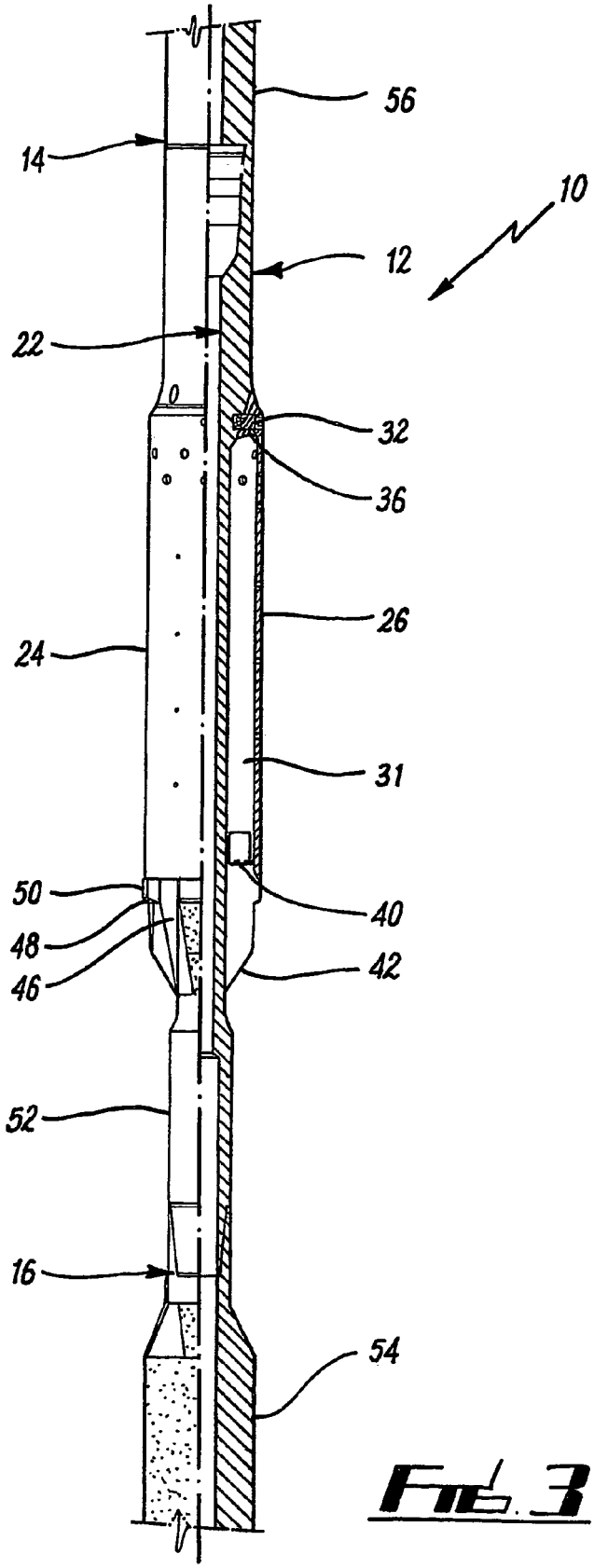
FIG. 3 is a downhole tool arranged on a work string according to a further embodiment of the present invention.

Reference is now made to FIG. 3 of the drawings, which illustrates the tool 10 including a mill 54 run ahead of the tool 10 on a work string 56. The mill 54 is located at a bottom end 16 of the tool 10. Like parts of the tool to those of FIGS. 1 and 2 have been given the same reference numeral. In this embodiment mill 54 may act as a pilot mill to drill or mill up pieces of junk which can then be jetted in through the channels 46 into ports 40 to the trap 31. This embodiment of the invention is suitable to be run after casing milling or window cutting operations to collect larger pieces of milling debris that are sometimes produced during these operations and could not be removed otherwise. The tool is also suitable for running through already perforated pipe to clean-up or remove perforating damage that restricts the inner diameter of the well bore and retrieve any perforation debris that cannot be circulated out of the well bore. Further, the mill 54 can be used to act as a tie back mill to clean out the inner diameter of a polished bore receptacle when the projections 44 and, in particular, the transverse surface 48 are landed on a polished bore receptacle and used to dress off the polished bore receptacle lip. Thus, it will be appreciated that multi-faceted surface 42 acts as an integral liner top dress mill on the tool 10.

The principal advantage of the present invention is that it provides a tool capable of capturing large pieces of junk or debris in a well bore by breaking up the junk and then collecting the junk in a trap.

A further advantage of the present invention is that by the use of a throat portion the junk laden fluid is jetted in to the trap for collection. This results in a tool which does not require to be rotated to create a centrifugal force to drive fluid through the tool and can therefore be operated by either being run into a well bore or via circulation of fluid upwards through the inlet ports 40.

A yet further advantage of the debris removal tool is that it can be operated on any portion of a work string and by virtue of the central bore 22 a separate fluid path is created so that fluids can be taken up or downhole separate from the fluid being attracted into the trap 31. Thus the tool can be operated on a drill string.

Various modifications may be made to the invention herein described without departing from the scope thereof. For instance, the number, size and arrangement of the ports 40 can be adjusted as long as there remains a large input surface into the trap to collect the larger pieces of junk. Further, it will be appreciated that the tool can be run with any other form of cleaning tool such as brushes and scrapers as long as they do not obstruct the passage of large junk being pushed towards the multi-faceted surface 42 for milling and grinding to be broken-up and thereby enter the ports 40.

Further, it will be appreciated that the ports on the sleeve can be varied in size, depending on the debris size which is acceptable within the well bore. If the fluid is to be entirely screened, then a screen or wire mesh filter may be appropriate.

The invention claimed is:

1. A downhole tool for collecting and retrieving junk from a well bore, the tool comprising:

a cylindrical body attachable in a work string;

said body having an internal throughbore, and independent of said throughbore, an external sleeve located around the body defining a trap for junk, a multi-faceted surface comprising a plurality of projections arranged at an end of the body for contacting with and breaking up junk; and a plurality of inlet ports through which the broken up junk passes into the trap for collection;

wherein each projection is located between adjacent inlet ports and extends below said ports and wherein adjacent projections define channels therebetween which are shaped to direct the junk into the respective inlet ports.

2. A downhole tool as claimed in claim 1 wherein the projections each include a plurality of tungsten carbide coated surfaces.

3. A downhole tool as claimed in claim 1 wherein the sleeve includes filter means for filtering debris from fluid passing there through.

4. A downhole tool as claimed in claim 3 wherein the trap is provided in an annular space between the body and the sleeve.

5. A downhole tool as claimed in claim 1 wherein the ports have a flow path parallel to a longitudinal axis of the tool.

6. A downhole tool as claimed in claim 1 wherein each inlet port includes a valve.

7. A downhole tool as claimed in claim 3 wherein the tool includes a throat, the throat being located adjacent to the projections and having a diameter narrower than a diameter of the sleeve.

8. A downhole tool as claimed in claim 1 wherein said throughbore in the cylindrical body is an axial bore to permit fluid flow through the work string.

9. A downhole tool as claimed in claim 7 wherein the tool includes one or more milling elements located adjacent the throat and distal to the inlet ports.

10. A method of collecting and retrieving junk within a well bore, by means of circulating fluid through a workstring and into an annulus around the workstring, the work string comprising a cylindrical body, said body having an internal throughbore, and an external sleeve located around the body defining a trap for junk, the method further comprising the steps:

(a) providing a multi-faceted contact surface on a work string, the surface including a plurality of projections and a plurality of inlet ports providing access to the trap, each projection being located between adjacent inlet ports;

(b) breaking up large pieces of junk by contact with the surface;

(c) directing the broken-up junk upwardly towards the inlet ports along channels defined between adjacent projections and into the trap directly from the annulus; and (d) storing the broken-up junk in said trap.

11. A method as claimed in claim 10 wherein the method includes the steps of providing a mill ahead of the surface and jetting milled junk from the mill towards the inlet ports.

12. A method as claimed in claim 10 wherein the method includes the step of operating one or more valves at each inlet port to prevent the broken-up junk from exiting the trap.

13. A downhole tool for collecting and retrieving junk from a well bore, the tool comprising:

a cylindrical body attachable in a work string, said body having an internal throughbore, and an external sleeve located around the body defining a trap for junk, wherein the body extends at least an entire length of the sleeve;

a multi-faceted surface comprising a plurality of projections arranged at an end of the body for contacting with and breaking up junk; and a plurality of inlet ports through which the broken up junk passes into the trap for collection wherein each projection is located between adjacent inlet ports.

14. A downhole tool for collecting and retrieving junk from a well bore, the tool comprising:

a cylindrical body attachable in a work string, said body having an internal throughbore;

an external sleeve located around the body defining a trap for junk, said sleeve having at one end thereof a plurality of inlet ports; and a multi-faceted surface arranged upon the body and comprising a plurality of projections for contacting with and breaking up junk, wherein each projection is located between adjacent inlet ports and wherein adjacent projections define channels therebetween which are shaped to direct the junk into the respective inlet ports.

* * * * *